United States Patent [19]

Ricketts

[11] 4,402,550

[45] Sep. 6, 1983

[54] METHOD FOR FORMING AN IN SITU OIL SHALE RETORT WITH CONTROLLED SEISMIC VIBRATION

[75] Inventor: Thomas E. Ricketts, Grand Junction, Colo.

[73] Assignee: Occidental Oil Shale, Inc., Grand Junction, Colo.

[21] Appl. No.: 344,532

[22] Filed: Feb. 1, 1982

Related U.S. Application Data

[63] Continuation-in-part of Ser. No. 183,144, Sep. 2, 1980, abandoned.

[51] Int. Cl.[3] ..... E21B 43/247; E21C 41/10

[52] U.S. Cl. ..... 299/2; 102/312; 166/259; 299/13

[58] Field of Search ..... 166/259, 299; 299/2, 299/13; 102/311, 312

[56] References Cited

U.S. PATENT DOCUMENTS 4,333,684 6/1982 Ricketts et al. ..... 299/2

*Primary Examiner*—Stephen J. Novosad
*Assistant Examiner*—George A. Suchfield
*Attorney, Agent, or Firm*—Christie, Parker & Hale

[57] ABSTRACT

An array of explosive charges is formed in a retort site in a subterranean formation containing oil shale. The explosive charges that are located around the perimeter of the retort site are smaller than the explosive charges located more remote from the perimeter. Formation within the retort site is explosively expanded toward a void formed in the site by detonating the explosive charges. This explosive expansion of formation results in a fragmented permeable mass of formation particles in the retort. Damage to objects near the retort site, which is caused by seismic shock from the detonations, is minimized by using smaller explosive charges around the perimeter than in the center of the retort site.

65 Claims, 3 Drawing Figures

METHOD FOR FORMING AN IN SITU OIL SHALE RETORT WITH CONTROLLED SEISMIC VIBRATION

CROSS-REFERENCE TO RELATED APPLICATIONS

This application is a continuation-in-part of application Ser. No. 183,144 filed Sept. 2, 1980, now abandoned, which is incorporated herein by this reference.

FIELD OF THE INVENTION

This invention relates to detonating explosive for explosively expanding unfragmented formation toward a void for forming a fragmented permeable mass of formation particles in an in situ oil shale retort while controlling seismic vibrations caused by such detonation.

BACKGROUND OF THE INVENTION

The presence of large deposits of oil shale in the high plateau, semi-arid region of the western United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents such as U.S. Pat. Nos. 3,661,423; 4,043,597; 4,043,598; and 4,192,554; and in U.S. patent application Ser. No. 070,319 filed Aug. 27, 1979, now abandoned, by Chang Yul Cha, entitled TWO-LEVEL, HORIZONTAL FREE FACE MINING SYSTEM FOR IN SITU OIL SHALE RETORTS. Each of these applications and patents is assigned to Occidental Oil Shale, Inc., assignee of this application, and each is incorporated herein by this reference.

These patents and applications describe in situ recovery of liquid and gaseous hydrocarbon materials from a subterranean formation containing oil shale, wherein such formation is explosively expanded to form a stationary fragmented permeable mass of formation particles containing oil shale within the formation, referred to herein as an in situ oil shale retort, or merely as a retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbons, and a residual carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off-gas is also withdrawn from the bottom of the retort. Such off-gas can include carbon dioxide generated in the combustion zone, gaseous products produced in the retorting zone, carbon dioxide from carbonate decomposition, and any gaseous retort inlet mixture that does not take part in the combustion process.

U.S. Pat. Nos. 4,043,597; 4,043,598; and 4,192,554 disclose methods for explosively expanding formation containing oil shale toward horizontal free faces to form a fragmented mass in an in situ oil shale retort. According to such a method, a plurality of vertically spaced apart voids are initially excavated, one above the other, within the retort site. A plurality of vertically spaced apart zones of unfragmented formation are temporarily left between the voids. Additionally, a plurality of vertical blastholes are drilled into each zone of unfragmented formation. The blastholes are loaded with explosive, forming an array of vertical columnar explosive charges in each zone of unfragmented formation. The explosive charges are then detonated to explosively expand each unfragmented zone upwardly and/or downwardly towards the void(s) above and/or below it to form a fragmented mass having an average void volume equal to the void volume of the initial voids. Retorting of the fragmented mass is then carried out to recover shale oil from the oil shale.

Blastholes formed in unfragmented formation can, for example, be 10 to 12 inches or even more in diameter and each explosive charge formed in the blastholes can have a length about one-half the thickness of the zone of unfragmented formation being expanded.

The zones of unfragmented formation being explosively expanded can be tens of feet thick. For instance, in U.S. Pat. No. 4,192,554, a zone of unfragmented formation 35 feet thick is explosively expanded toward a void. In this embodiment, zones of unfragmented formation provided are 160 feet long and about 160 feet wide with a total of 81 blastholes formed in such a zone. Therefore, 81 explosive charges which have a length of about $17\frac{1}{2}$ feet are formed in the zone of unfragmented formation.

Detonating explosive in a single round in such a zone of unfragmented formation produces a powerful explosion which generates seismic shock waves travelling outwardly through unfragmented formation extending away from the blasting site.

Seismic shock from such a powerful explosion can cause rock falls and serious damage to equipment and structures, such as bulkheads and piping, in nearby underground workings. Also, equipment and buildings located nearby above ground can be damaged by such detonation.

Thus, it is desirable to provide a method which provides a desired amount of fragmentation, while controlling, i.e., minimizing, seismic effects at locations near the blasting site.

SUMMARY OF THE INVENTION

This invention relates to a method for forming a fragmented permeable mass of formation particles in an underground cavity having top, bottom, and side boundaries of unfragmented formation. At least one limited void is excavated in a subterranean formation while leaving at least one zone of unfragmented formation adjacent such a limited void. A plurality of spaced apart central blastholes are formed in the zone of unfragmented formation remote from the cavity side boundaries. Additionally, a plurality of spaced apart outer blastholes are formed in the zone of unfragmented formation surrounding the central blastholes and adjacent the cavity side boundaries. The distance between adjacent outer blastholes is less than the distance between adjacent central blastholes. Explosive is loaded into the central blastholes for forming a central explosive charge in each central blasthole. Explosive is loaded into the outer blastholes for forming an outer explosive charge in each outer blasthole. Each outer explosive charge substantially fills the entire cross-sectional area of such an outer blastholes and the energy per unit length of such an outer explosive charge is less than the energy per unit length of such a central explosive charge. The explosive charges are then detonated for explosively expanding the zone of unfragmented formation toward the limited void for forming the fragmented permeable mass of formation particles in the undergound cavity.

DRAWINGS

These and other features, aspects, and advantages of the present invention will be more fully understood when considered with respect to the following detailed description, appended claims, and accompanying drawings, wherein:

DETAILED DESCRIPTION

Figure 1:
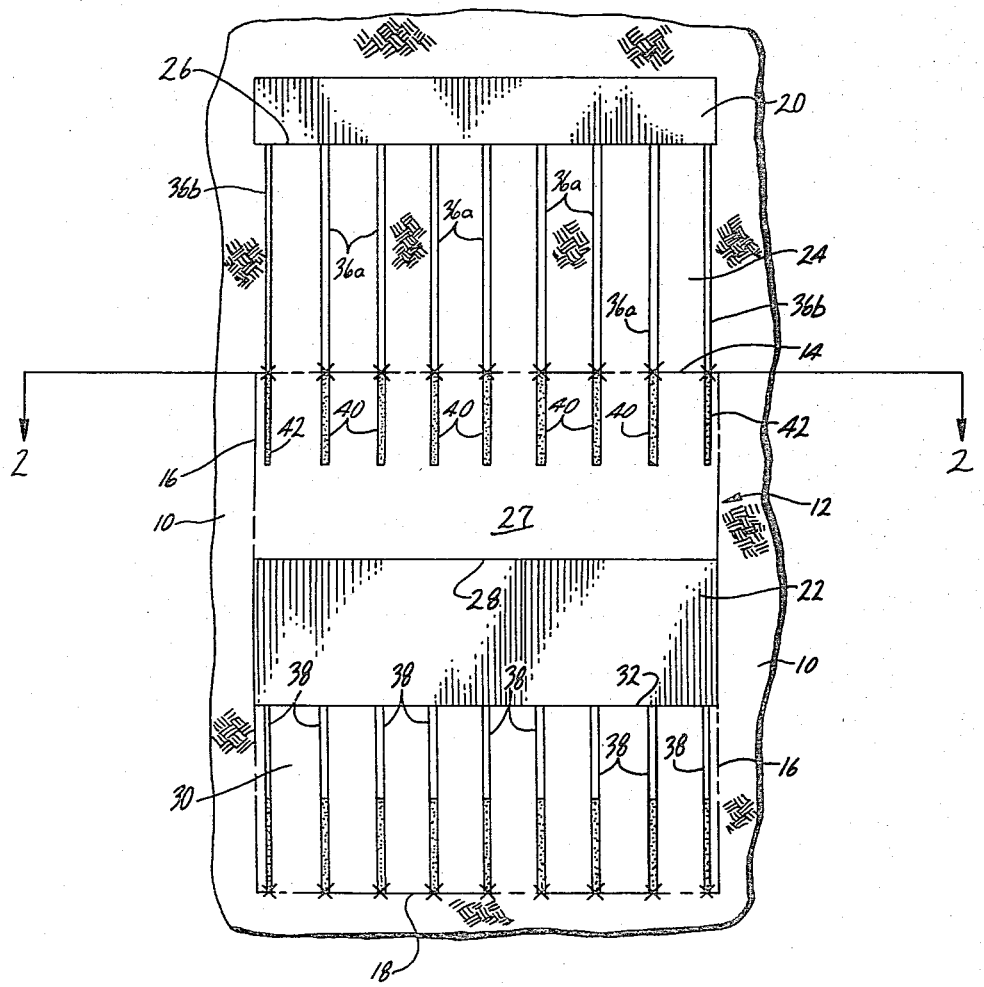
FIG. 1 is a fragmentary, semi-schematic vertical cross-sectional view showing a portion of a subterranean formation containing oil shale at one stage during preparation for explosive expansion for forming an in situ oil shale retort.

Referring to FIG. 1, there is shown a semi-schematic vertical cross-sectional view of a portion of a subterranean formation 10 containing oil shale at one stage of preparation for explosive expansion for forming an in situ oil shale retort 12. The in situ retort, when formed, comprises an underground cavity in the formation 10 that is rectangular in horizontal cross-section, having a top boundary 14, four vertically extending side boundaries 16, and a bottom boundary 18 of unfragmented formation. If desired, retorts having other horizontal cross-sections or other shapes can also be formed by practice of principles of this invention.

When explosively expanding formation using a horizontal free face system of an exemplary embodiment, an open base of operation 20 can be excavated in the formation for providing effective access across substantially the entire horizontal cross-section of the retort being formed. The base of operation can be used during formation of the retort and additionally can facilitate ignition of a fragmented permeable mass of formation particles formed in the retort. The base of operation can also provide a location for control of introduction of oxygen-supplying gas into the retort and for evaluating performance of the retort during its operation. If desired, such an underground base of operation can be deleted and the aforementioned operations performed from the ground surface. Alternatively, access can be afforded from a drift or drifts extending above or adjacent the retort.

A generally horizontally extending void 22 is excavated in the retort site at a level spaced vertically below the base of operation, leaving a layer or zone of unfragmented formation which extends vertically between the base of operation 20 and the void 22. It is desired that the void comprise at least about 15% up to about 45% of the total volume of the retort being formed.

In one exemplary embodiment, the void 22 is a "limited void" with respect to the volume of formation to be explosively expanded toward that void. That is, the void has less available volume than would be required for free expansion of formation towards the void.

When an earth formation is explosively fragmented and expanded, it increases in bulk due to the void space in interstices between the particles. The maximum expansion of an oil shale formation into an unlimited void results in a fragmented mass having an average void fraction of about 35%; that is, about 35% of the total volume occupied by the fragmented mass is void space between the particles. The volume occupied by the fragmented mass is about 55% larger than the volume occupied by the original unfragmented formation after such unlimited or free expansion. This is sometimes referred to as a bulking factor of 55%.

A "limited void" is one where the void space available for explosive expansion is less than needed for free bulking of the formation expanded towards that void. Thus, if a void has an excavated volume less than about 35% of the total of the volume of the void plus the volume occupied by formation explosively expanded, it is necessarily a limited void. It has been found that factors in addition to total available void can make a void "limited" even though the total available void may appear sufficient for free bulking. Thus, the fragmented mass formed by explosive expansion may not expand to completely fill available void space and the average void fraction in the fragmented mass may be less than projected from the available void space.

A layer of unfragmented formation may be left above the void 22 comprising a sill pillar 24 of unfragmented formation which extends from about the floor 26 of the base of operation to the top boundary 14 of the retort being formed. The sill pillar acts as a barrier between the in situ oil shale retort and the base of operation during retorting operations, thereby protecting the base of operation from heat and from gases evolved during such retorting operations.

The layer of unfragmented formation also comprises an upper zone 27 of unfragmented formation. The upper zone of unfragmented formation extends horizontally across the retort site between the top boundary 14 of the retort being formed and a substantially horizontal free face 28 above the void 22. A lower zone 30 of unfragmented formation is left in the subterranean formation below the void, wherein the lower zone extends horizontally across the retort site between the bottom boundary 18 of the retort being formed and a substantially horizontal free face 32 at the floor of the void. Both the upper and lower zones of unfragmented formation, 27 and 30 respectively, are explosively expanded toward the limited void 22, i.e., toward the horizontal free faces 28 and 32, for forming a fragmented permeable mass of formation particles 52 (shown in FIG. 3) that has a reasonably uniform void fraction distribution and permeability. Forming a fragmented mass having a uniform void fraction distribution and permeability enhances efficient retorting by inhibiting gas channeling and promoting uniform gas flow distribution through the retort.

In the exemplary embodiment, unfragmented formation is expanded toward only one void, i.e., the limited void 22, for clarity of illustration. If desired, however, in practice of principles of this invention, more than one void can be excavated in the subterranean formation and formation can be expanded toward the excavated voids.

Additional details of expanding formation toward several voids is described in U.S. Pat. No. 4,192,554, incorporated hereinabove by reference.

In the exemplary embodiment, a plurality of substantially vertical horizontally spaced apart blastholes 36 are drilled through the sill pillar 24 and into the upper zone 27 of unfragmented formation from the base of operation 20, forming an array of spaced apart blastholes 36 which are perpendicular to the upper free face 28. In other embodiments, where no underground base of operation is provided, the blastholes can be drilled from the ground surface or from a drift or drifts above or adjacent the side boundaries of the retort.

Additionally, a plurality of substantially vertical horizontally spaced apart blastholes 38 are drilled into the lower zone 30 of unfragmented formation from the void 22, forming another array of spaced apart blastholes. The blastholes 38 are perpendicular to the lower free face 32.

The blastholes 36 and 38 are shown out of proportion of the figures for clarity of illustration, i.e., the blastholes are actually much smaller in diameter relative to the formation than shown.

The upper and lower zones of unfragmented formation are prepared for explosive expansion by loading explosive into the blastholes 36 in the upper zone and into the blastholes 38 in the lower zone. Since the configuration of the array of blastholes and the explosive charges in both the upper and lower zones can be the same, the description of blasthole patterns and configurations of explosive charges will be limited to those in the upper zone for simplicity.

Figure 2:
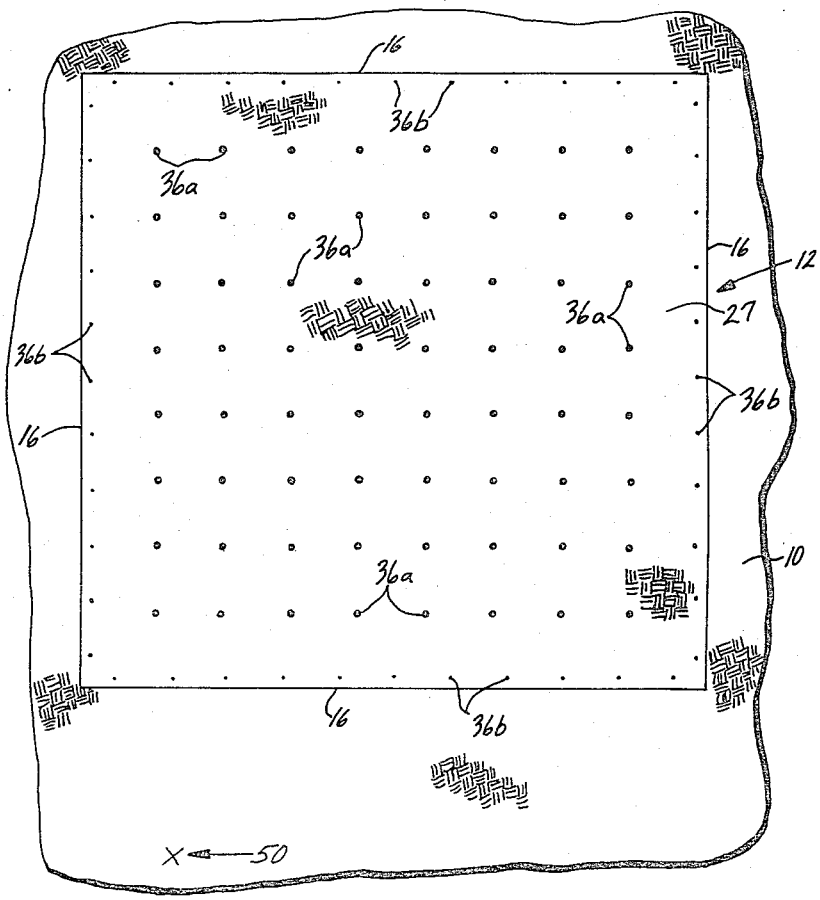
FIG. 2 is a semi-schematic horizontal cross-sectional view taken on line 2—2 of FIG. 1 showing an array of blastholes.

An exemplary pattern of blastholes used in practice of this invention can be better understood by referring to FIG. 2. FIG. 2 is a semi-schematic horizontal cross-sectional view taken on line 2—2 of FIG. 1 which shows the array of blastholes 36 formed in the upper zone of unfragmented formation. The outline of the horizontal free face 28 is indicated by the side boundaries 16 of the retort which surround the array of blastholes 36.

The array of blastholes 36 is illustratively shown as comprising a square array of horizontally spaced apart central blastholes 36*a*, with the central blastholes formed in parallel rows. The blastholes 36*a* are remote from the side boundaries 16 and are surrounded by a band of outer blastholes 36*b*. The "band" of outer blastholes comprises a row of horizontally spaced apart vertical blastholes adjacent each side boundary 16 of the retort.

The spacing distance between the outer blastholes 36*b* is less than the spacing distance between the central blastholes 36*a*. Additionally, the diameter of each outer blasthole is less than the diameter of such a central blasthole.

The "spacing distance" as referred to herein is the distance between adjacent blastholes or explosive charges.

Referring again to FIG. 1, explosive is loaded into the central blastholes 36*a* forming an array of horizontally spaced apart substantially vertical columnar central explosive charges 40. Also, explosive is loaded into the blastholes 36*b*, forming a band of substantially vertical columnar outer explosive charges 42 surrounding the central explosive charges. The "band" of outer explosive charges 42 comprises a row of horizontally spaced apart substantially vertical columnar outer explosive charges adjacent each side boundary 16 of the retort. Thus, the columnar central charges 40 and the columnar outer charges 42, together, form an array of explosive charges extending horizontally across the entire cross-section of the retort. A detonator designated by an "x" is placed into each explosive charge at the base of the charge and the charges are stemmed with inert material, as appropriate. If desired, detonators can be placed at a location in each charge other then at the base.

The central and outer explosive charges substantially completely fill the horizontal cross-section of the blastholes for a sufficient depth to expand all of the formation of the upper zone 27 of unfragmented formation toward the horizontal upper free face 28.

It is believed that the most efficient use of explosive is obtained when each outer explosive charge 42 and each central explosive charge 40 extends from about the top boundary of the retort being formed about one-half the distance to the free face 28 toward which the upper zone of unfragmented formation is to be expanded.

The charge length, therefore, of each outer and central charge is preferably about equal and each such charge preferably has a length equal to about one-half the thickness of the upper zone 27 of unfragmented formation that is to be expanded. Preferably, the length to diameter ratio of the columnar charges used in practice of this invention is greater than about ten to one.

Since the outer blastholes have smaller diameters than the central blastholes, each outer explosive charge 42 is smaller than each central charge 40. Accordingly, each outer explosive charge has an energy per unit length that is less than the energy per unit length of each central explosive charge. Additionally, each outer explosive charge has a scaled depth of burial that is greater than the scaled depth of burial of each cental explosive charge.

In the exemplary embodiment, each central explosive charge 40 comprises about the same amount of explosive and has about the same actual depth of burial as each other central explosive charge. Therefore, the scaled depth of burial of each row of central explosive charges is about equal.

The "actual depth of burial" as used herein is the distance from the free face towards which formation is to be expanded to the center of mass or centroid of an explosive charge.

The scaled depth of burial, as it applies to cratering, is described by B. B. Redpath in an article entitled "Application of Cratering Characteristics to Conventional Blast Design", *Monograph l on Rock Mechanics Applications in Mining,* Soc. Min. Eng. and Am. Inst. Min. Met. and Pet. Eng., New York, 1977. A copy of this article accompanies the application and is incorporated herein by this reference.

The scaled depth of burial (SDOB) of an explosive charge can be expressed in units of distance over weight to the $\frac{1}{3}$ power or, preferably, distance over energy of explosive to the $\frac{1}{3}$ power. For example, $SDOB = L/W^{\frac{1}{3}}$ with units of millimeters per calorie to the $\frac{1}{3}$ power. The distance, L, referred to as burden distance in the equation for scaled depth of burial, is the actual depth of burial as described hereinabove. The weight or energy, W, of the explosive is the total weight or energy of the column of explosive.

The scaled depth of burial of a row of explosive charges can be determined by using relationships which relate rows of vertical columnar explosive charges to line charges. For example, in the paper by Redpath, an equation is developed as follows:

$$DOB_{ln} = SDOB_{ln} \times W/S^{\frac{1}{2}}$$

wherein:

W = the charge weight of each explosive charge in a row;

S = the spacing distance between explosive charges in a row;

$DOB_{ln}$ = the actual depth of burial of each explosive charge in a row, i.e., the actual depth of burial of a line charge; and $SDOB_{ln}$ = the scaled depth of burial of a line charge.

It can be seen that the scaled depth of burial of a row of charges can be altered by changing the actual depth of burial of the explosive charges in the row and/or by charging the spacing distance between explosive charges and/or by changing the amount of explosive in each blasthole. The amount of explosive in each blasthole can be changed by changing the diameter of the blasthole and/or by using more or less energetic explosive in such a blasthole and/or by changing the charge length.

In the exemplary embodiment, each outer explosive charge has about the same amount of explosive and about the same actual depth of burial as each other outer explosive charge. Therefore, each row of outer explosive charges along each side boundary 16 has about the same scaled depth of burial.

It is preferred that the scaled depth of burial of each outer row of explosive charges is about equal to the scaled depth of burial of each row of central charges.

Having the SDOB of each outer row about equal to the SDOB of each central row enhances the uniform expansion of the zones of unfragmented formation. Additionally, having a SDOB of each outer row about equal to the SDOB of each central row enables the use of a procedure by which a desired scaled depth of burial can initially be selected for the entire array and this desired SDOB is maintained by selecting the proper combination of spacing and blasthole (and hence, charge) diameter for the outer blastholes **36*b***.

Although spacing distance between outer charges can be made very small relative to the spacing between central charges, it is desired that the spacing distance between outer explosive charges be at least about $\frac{1}{2}$ the spacing distance between central charges. This is due to the high cost involved in drilling and loading additional outer blastholes and for other operational reasons.

In an exemplary embodiment, therefore, when the SDOB of an outer row is about equal to the SDOB of a central row, each outer explosive charge preferably contains no less than about one-half the amount of explosive as is contained in a central charge.

Once the desired amount of explosive is selected for each outer explosive charge, the spacing distance between outer blastholes is selected. The spacing distance between outer blastholes is preferably chosen so that the ratio of spacing distance between outer blastholes to the amount of explosive in each outer explosive charge is about equal to the ratio of the spacing between central blastholes to the amount of explosive in each such central charge. This maintains the scaled depth of burial of the array at the preselected desired value.

For example, if the spacing distance between outer explosive charges is about $\frac{3}{4}$ the spacing distance between central charges, preferably the diameter of the outer charges is selected so that each outer charge will contain about $\frac{3}{4}$ the amount of explosive as is contained in each central charge.

When the above described preferred ratios of explosive and spacing are used for outer and central explosive charges, the ratio of explosive energy per unit length of such an outer charge to the spacing distance between outer charges is about equal to the ratio of the explosive energy per unit length in each central charge to the spacing distance between the central charges. Additionally, the ratio of the total amount of explosive in a row of outer charges along a side boundary to the length of such an outer row is about equal to the ratio of the total amount of explosive in a row of central charges to the length of such a row of central charges.

By practice of principles of this invention, explosive is more evenly distributed in the region along the side boundaries than in other regions of the retort being formed.

As noted above, the lower zone of unfragmented formation is loaded with explosive for expanding the lower zone in a similar manner as is the upper zone. The explosive in both zones of unfragmented formation is thereafter detonated for explosively expanding the zones of unfragmented formation toward the limited void 22 forming the fragmented permeable mass of formation particles in the retort.

By using an exemplary blast design of this invention, the seismic peak particle velocity from detonation of explosive is less at an arbitrarily selected location 50 in FIG. 2 than the peak particle velocity which results from using a blast design where the outer charges are the same size as the central charges. The position of the arbitrarily selected location 50 is not material since a reduction in seismic peak particle velocity is found at any location in the retort site.

In addition to reducing the seismic peak particle velocity, the exemplary blasting pattern produces less wall damage in unfragmented formation adjacent the fragmented mass in the retort than a blasting pattern where the outer charges are the same size as the central charges. This is because of the smaller amount of explosive per hole adjacent the side boundary.

It also appears that the exemplary blasting pattern should result in less possibility of channeling gas flow adjacent side boundaries of the retort, since there is less tendency to expand formation inwardly from the side boundaries toward the center of the retort when outer explosive charges are smaller than the central charges.

It is also believed that better fragmentation is obtained since there is more uniform distribution of explosive in the formation when using the exemplary blasting pattern than when the outer explosive charges are made the same size as the central charges.

It has been observed that when the spacing and size of the outer charges is equal to the spacing and size of the central charges, relatively large particles of formation are found near the edges of the fragmented mass explosively expanded toward a horizontal free face. It is believed that by spacing smaller diameter blastholes closer together along the boundaries of the retort, the particle size in this region is reduced.

Thus, for the foregoing reasons, by practice of principles of this invention, uniformity of void fraction distribution of the fragmented mass is promoted, while gas channeling is reduced.

The time delay pattern for detonating explosive charges in the array of blastholes 36 does not appear to be critical in this development. The same effects are believed to be obtained where all of the charges are detonated simultaneously or when a single round time delay pattern of arbitrary sequence is selected. A "single round" as used herein means detonation of a number of separate explosive charges, either simultaneously or with only a short time delay between separate detonations. A time delay between explosions in a sequence is short when formation explosively expanded by detonation of one explosive charge has either not yet moved or is still in motion at the time of detonation of a subsequent explosive charge.

Although, in practice of principles of this invention, the explosive charges can be detonated simultaneously, preferably the charges are detonated in a single round delay pattern to further promote uniformity of void fraction distribution and permeability of the fragmented mass being formed.

In one exemplary embodiment of such a single round delay pattern when using an array of horizontally spaced apart vertical columnar explosive charges to expand formation toward a horizontal free face, explosive charges in the array near the center of the retort are detonated first, followed sequentially by detonation of explosive charges in bands moving radially outwardly from the center. Other sequences can be used if desired.

Preferably, the time period between detonations or delays in such a single round is sufficiently short so that proper interaction between all of the charges in the array of explosive charges is achieved. When charge interaction is proper, all of the unfragmented formation located between an imaginary plane that extends horizontally through the bases of the charges and the horizontal free face is explosively expanded as desired. For example, referring again to FIG. 1, when the explosive charges 40 and 42 are detonated in a single round time delay sequence and proper interaction is achieved between all of the charges in the array, the entire zone of unfragmented formation 27, i.e., all of the formation extending between the top boundary 14 of the retort and the horizontal free face 28, is expanded toward the void 22.

On the other hand, when charge interaction is not proper, the charges do not pull all the way to their bases, i.e., they do not fragment some portions of the formation located between their distil ends and their bases. Thus, formation is not fragmented to the desired extent and, additionally, the resulting fragmented mass does not have a desired uniformity of void fraction distribution.

When, as in the illustrated embodiment, the explosive charges are vertical columnar charges aligned perpendicular to a horizontal free face, it is desirable that the amount of formation expanded vertically toward the horizontal free face is maximized to enhance uniformity of void fraction distribution of the fragmented mass formed. It is thought that when the time period between detonation of sequential delays is too long, formation being expanded is not directed to the extent desired toward the horizontal free face, but instead is directed laterally toward generally vertical free faces that are newly formed by a previous detonation. This can result in a fragmented mass having uneven void fraction distribution horizontally across the retort.

Thus, the explosive expansions of unfragmented formation useful in practice of this invention are cratering type blasts, i.e., blasts directed substantially toward a single free face rather than bench type blasts directed toward more than one free face.

It is believed that unfragmented formation is expanded as desired toward a horizontal free face and that proper interaction between charges in sequential delays is achieved when the time period between such delays is less than about 3 milliseconds per foot of spacing between an explosive charge in one delay and an adjacent explosive charge in the next delay. For example, retorts having a fragmented mass with a satisfactorily uniformly distributed void fraction have been formed using a time period between detonation of sequential delays of about 1 millisecond per foot of spacing between adjacent explosive charges in such delays.

In an exemplary embodiment of practice of this invention, the central blastholes **36*a* within the center portion of the retort site can have a spacing distance of about 20 feet, with each blasthole having a 10-inch diameter. The blastholes 36*b*** along the side boundaries can have a 9-inch diameter and a spacing distance of about 14 feet.

In the array illustrated in FIG. 2, for example, there are 49 central blastholes **36*a* in the center array having a 20-foot spacing distance and 44 outer blastholes 36*b*** along the side boundaries having a 14-foot spacing distance. It will be noted that this arrangement leaves no blasting holes in precisely the corners of the retort site. If desired, additional blastholes can be added in this region.

The blast design described above reduces the peak particle velocity at the arbitrarily selected location 50 spaced horizontally from the retort by about 20% as compared with a blast design where 10-inch holes are provided on 20-foot centers throughout the whole retort site.

This exemplary blast design results in the ratio of spacing distance to the amount of explosive in each outer blasthole being slightly less than the ratio of spacing distance to amount of explosive in each central blasthole. This can be due to practical considerations of drilling as noted above. For example, only certain size drill bits are available, and there are an integral number of blasthole spacings in a row of blastholes along a side boundary of a retort.

With the practical limitations in mind, however, it is desired that the ratio of spacing distance to amount of explosive in each outer blasthole be made as close as possible to the ratio of spacing distance to amount of explosive in each central blasthole.

In another embodiment, 10-inch central blastholes are spaced 20 feet apart and 8-inch outer blastholes are used along the side boundaries. A spacing distance of about 13 feet between such outer blastholes provides each row of outer explosive charges with about the same scaled depth of burial as each row of central explosive charges. Such a blasting pattern reduces the seismic peak particle velocity at the arbitrarily selected location 50 by about 36% as compared with the peak particle velocity when 10-inch blastholes on a 20-foot spacing distance are used throughout the entire retort site.

Although described in embodiments where smaller blastholes closer together are arranged along each side boundary of the retort, the same principles are applicable where minimization of seismic peak particle velocity is desired in just one or more directions relative to the retort site. Thus, for example, if the seismic peak particle velocity is of concern only in one direction from the retort site, smaller blastholes having less spacing distance can be used solely along this boundary of the retort site.

Additionally, if desired, instead of each blasthole along a side boundary of the retort having a smaller spacing distance and a smaller diameter, a plurality of blastholes along one or more side boundaries can be spaced closer together. For instance, several first outer blastholes, which are closer to objects sensitive to damage from seismic vibrations, can be placed closer together and have a smaller diameter than the remaining outer blastholes along the outer boundaries of the retort.

Although the exemplary embodiment of practice of principles of this invention is described in terms of explosive charges in vertical blastholes, the technique can also be useful when the blastholes are not vertical, e.g., when they are horizontal or extend at other angles.

Also, practice of principles of this invention can be used when cratering to the ground surface.

This technique for alleviating seismic shock at locations spaced apart from the retort should be distinguished from prior blasting techniques known as smooth blasting and pre-splitting or pre-shearing.

Details of pre-shearing and smooth blasting can be found in *The Blasters' Handbook,* E. I. DuPont de Nemours & Co. (Inc.), 15th edition (1942), pp 399–420, and in *Swedish Blasting Technique,* SPI, Gothenburg, Sweden (1973), pp 163–180.

In pre-splitting, an array of blastholes is formed which comprises a row of small diameter blastholes along a boundary of the formation being excavated. The spacing distance between the small diameter blastholes is less than the spacing distance between larger diameter blastholes in the array.

The blastholes used for pre-splitting are then very lightly loaded with explosive compared to the other blastholes in the array. The light loads of explosive, for instance, can comprise a plurality of spaced apart, full or partially full, cartridges of dynamite on a detonating cord which extends down the center of the blasthole. If desired, a continuous column of explosive can also be used extending down the center of the blasthole. In either case, the loads do not completely fill the cross-section of the blasthole and an air gap is left between the explosive charge and the blasthole walls. If desired, the air gap can be filled by placing stemming completely around and between the charges.

The recommended loading density for blastholes used for pre-splitting is given as from about 0.08 to about 0.75 pounds of explosive per foot of blasthole in blastholes of various diameters. This is significantly less than loading densities used for a standard charge in a blasthole.

The pre-splitting charges are all detonated before the remaining explosive charges in the array and cause cracking along the boundary of unfragmented formation which is being expanded.

In smooth blasting, a configuration of blastholes is used which is similar to the configuration of blastholes used for pre-splitting. The explosive charges in the blastholes along the perimeter of the unfragmented formation used for smooth blasting are detonated last, after the explosive charges in the other blastholes of the array have been detonated.

In smooth blasting, as was the case for pre-splitting, the blastholes along the perimeter are very lightly loaded with explosive. The recommended explosive charge density in blastholes of various diameter used for smooth blasting, for example, is from about 0.12 to about 0.25 pounds of explosive per foot of blasthole. This is significantly less than loading densities used for a standard charge in a blasthole.

Figure 3:
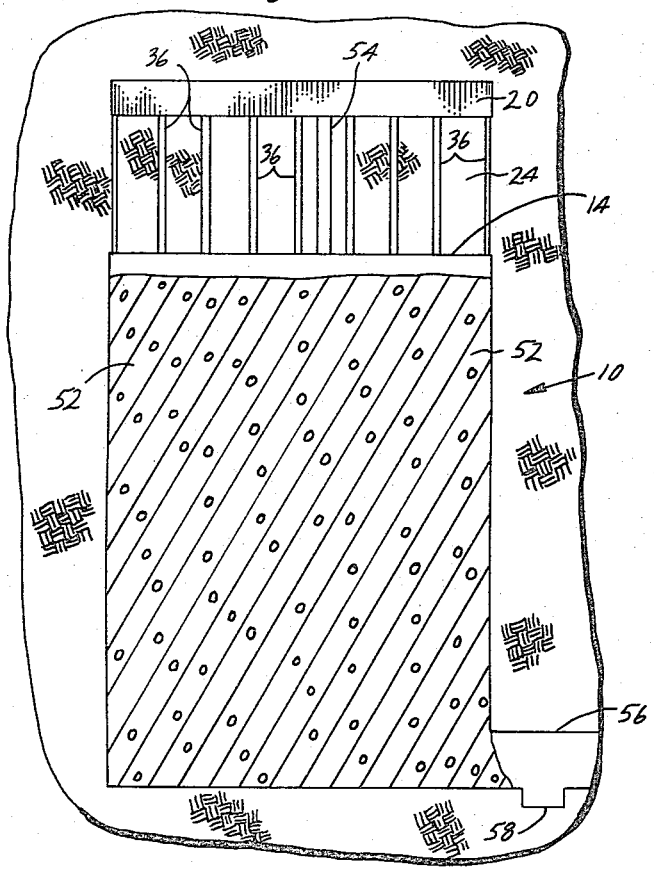
FIG. 3 is a fragmentary semi-schematic vertical cross-sectional view of an in situ oil shale retort formed in accordance with this invention.

Referring to FIG. 3, after having formed the fragmented permeable mass 52 of oil shale particles in an in situ oil shale retort 10, the final preparation steps for producing liquid and gaseous products from the retort are carried out. These steps include drilling at least one gas feed inlet passage 54 downwardly from the base of operation 20 to the top boundary 14 of unfragmented formation, so that oxygen-supplying gas can be introduced into the fragmented mass during retorting operations.

Alternatively, at least a portion of the blastholes 36 through the sill pillar 24 can be used for introduction of the oxygen-supplying gas. Alternatively, if desired, the sill pillar 24 can also be explosively expanded. In such an embodiment, a retort inlet mixture is introduced from an overlying or laterally adjacent drift. A substantially horizontal product withdrawal drift 56 extends away from the lower portion of the fragmented mass at a lower production level in the retort. The product withdrawal drift is used for removal of liquid and gaseous products of retorting.

If desired, liquid and gaseous products can be withdrawn through one or more raises which extend upwardly from a lateral drift under the retort into a bottom portion of the fragmented mass.

During retorting operations, a combustion zone is established in the fragmented mass of formation particles and the combustion zone is advanced downwardly through such fragmented mass by introduction of oxygen-supplying gas into the retort. Combustion gas produced in the combustion zone passes through the fragmented mass to establish a retorting zone on the advancing side of the combustion zone, wherein kerogen in oil shale is retorted to produce liquid and gaseous products of retorting. The liquid products and an off-gas containing gaseous products pass to the bottom of the fragmented mass and are withdrawn from the product withdrawal drift 56. A pump (not shown) is used to withdraw liquid products from a sump 58 to above ground. Off-gas is withdrawn by a blower (not shown) and passed to above ground.

The above description of a method for recovering shale oil from a subterranean formation containing oil shale, including the description of preparing zones of unfragmented formation, for explosive expansion, is for illustrative purposes. Because of variations which will be apparent to those skilled in the art, the present invention is not intended to be limited to the particular embodiments described above. The scope of the invention is defined in the following claims.

What is claimed is:

1. A method for forming a fragmented permeable mass of formation particles in an underground cavity in a subterranean formation, the underground cavity having top, bottom, and side boundaries of unfragmented formation, comprising the steps of:

(a) excavating at least one limited void within the cavity boundaries in the subterranean formation while leaving at least one zone of unfragmented formation within the cavity boundaries adjacent such a limited void;

(b) forming a plurality of spaced apart central blastholes in such a zone of unfragmented formation remote from the cavity side boundaries;

(c) forming a plurality of spaced apart outer blastholes in the zone of unfragmented formation surrounding the central blastholes and adjacent the cavity side boundaries, the distance between adjacent outer blastholes being less than the distance between adjacent central blastholes;

(d) loading explosive into the central blastholes for forming a central explosive charge in each such central blasthole;

(e) loading explosive into the outer blastholes for forming an outer explosive charge in each such outer blasthole, such an outer explosive charge substantially filling the entire cross-sectional area of such an outer blasthole, the energy per unit length of such an outer explosive charge being less than the energy per unit length of such a central explosive charge; and (f) detonating the central and outer explosive charges for explosively expanding the zone of unfragmented formation toward the limited void for forming the fragmented permeable mass of formation particles in the underground cavity.

2. The method according to claim 1 wherein the actual depth of burial of each such central explosive charge is about equal to the actual depth of burial of each such outer explosive charge.

3. The method according to claim 1 wherein the distance between adjacent outer blastholes is at least about one-half the distance between adjacent central blastholes.

4. The method according to claim 1 wherein the ratio of the distance between adjacent outer blastholes to the amount of explosive in each outer blasthole is about equal to the ratio of the distance between adjacent central blastholes to the amount of explosive in each central blasthole.

5. The method according to claim 1 wherein the column length of each such outer explosive charge is about equal to the column length of each such central explosive charge.

6. The method according to claim 1 wherein such a zone of unfragmented formation comprises a free face adjacent the limited void and the central and outer blastholes are substantially perpendicular to the free face.

7. The method according to claim 1 wherein such a limited void extends generally horizontally in the subterranean formation, such a zone of unfragmented formation comprises a substantially horizontally extending free face adjacent the void, and the central and outer blastholes are substantially perpendicular to the free face.

8. The method according to claim 1 wherein the central and outer explosive charges are detonated in a single round.

9. The method according to claim 1 comprising detonating the central and outer explosive charges in such a zone of unfragmented formation in a single round of sequential detonations wherein the time delay between separate detonations in the sequence is sufficiently short so that proper interaction is achieved between all of the charges.

10. The method according to claim 1 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

11. The method according to claim 1 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

12. A method for forming a fragmented permeable means of formation particles in an underground cavity in a subterranean formation, the underground cavity having top, bottom, and side boundaries of unfragmented formation, comprising the steps of:

(a) excavating at least one limited void within the cavity boundaries in the subterranean formation while leaving at least one zone of unfragmented formation within the cavity boundaries adjacent such a limited void;

(b) forming a plurality of spaced apart central blastholes in such a zone of unfragmented formation;

(c) forming a plurality of spaced apart outer blastholes in the zone of unfragmented formation surrounding the central blastholes and adjacent such a retort side boundary, the distance between at least a first portion of adjacent outer blastholes being less than the distance between adjacent central blastholes, wherein the first portion of adjacent outer blastholes is nearer to objects sensitive to damage by seismic shock than the remainder of the outer blastholes;

(d) loading explosive into the central blastholes for forming a central explosive charge in each central blasthole;

(e) loading explosive into the outer blastholes for forming an explosive charge in each outer blasthole, such an outer explosive charge substantially filling the entire cross-sectional area of such an outer blasthole, the actual depth of burial of each such outer explosive charge being about equal to the actual depth of burial of each such central explosive charge while the energy per unit length of such an outer explosive charge in the first portion of adjacent outer blastholes is less than the energy per unit length of such a central explosive charge; and (f) detonating the central and outer explosive charges for explosively expanding the formation toward the limited void for forming the fragmented permeable mass of formation particles in the underground cavity.

13. The method according to claim 12 wherein such a zone of unfragmented formation comprises a free face adjacent the limited void and the central and outer blastholes are generally perpendicular to the free face.

14. The method according to claim 13 comprising detonating the central and outer explosive charges in a single round of sequential detonations wherein the length of the time delay between separate detonations in the sequence is less than about 3 milliseconds per foot of spacing between an explosive charge in one delay and an adjacent explosive charge in the next delay in the sequence.

15. A method for forming a fragmented permeable mass of formation particles in an underground cavity in a subterranean formation containing oil shale, the underground cavity having top, bottom, and side boundaries of unfragmented formation comprising the steps of:

(a) excavating at least one void within the cavity boundaries in the subterranean formation, while leaving at least one zone of unfragmented formation within the cavity boundaries adjacent such a void;

(b) forming a plurality of spaced apart central blastholes in such a zone of unfragmented formation remote from the cavity side boundaries;

(c) forming a plurality of spaced apart outer blastholes in the zone of unfragmented formation surrounding the central blastholes and adjacent the cavity side boundaries, the distance between adjacent outer blastholes being less than the distance between adjacent central blastholes;

(d) loading explosive into the central blastholes for forming a central explosive charge in each such central blasthole;

(e) loading explosive into the outer blastholes for forming an outer explosive charge in each such outer blasthole, such as outer explosive charge substantially filling the entire cross-sectional area of such an outer blasthole, the actual depth of burial of each such outer explosive charge being about equal to the actual depth of burial of each such central explosive charge while the energy per unit length of such an outer explosive charge is less than the energy per unit length of such a central explosive charge; and (f) detonating the central and outer explosive charges in such a zone of unfragmented formation in a single round comprising a sequence of separate detonations for explosively expanding the zone of unfragmented formation toward the void for forming the fragmented permeable mass of formation particles in the underground cavity, the time delay between detonations in the sequence being sufficiently short so that proper interaction is achieved between all of the charges.

16. The method according to claim 15 wherein the magnitude of such a time delay between detonations in the sequence is less than about 3 milliseconds per foot of spacing between an explosive charge in one delay and an adjacent explosive charge in the next delay in the sequence.

17. The method according to claim 16 wherein the magnitude of such a time delay between detonations is about 1 millisecond per foot of spacing between an explosive charge in one delay and an adjacent explosive charge in the next delay in the sequence.

18. A method for forming a fragmented permeable mass of formation particles in an in situ retort in a subterranean formation, the in situ retort having top, bottom, and side boundaries of unfragmented formation, comprising the steps of:

(a) excavating at least one limited void within the retort boundaries in the subterranean formation, while leaving at least one zone of unfragmented formation within the retort boundaries adjacent such a limited void;

(b) forming an array of blastholes in such a zone of unfragmented formation comprising at least one row of spaced apart central blastholes remote from the side boundaries of the retort;

(c) forming a row of outer blastholes in such a zone of unfragmented formation adjacent at least one side boundary of the retort, the distance between adjacent outer blastholes being less than the distance between adjacent central blastholes;

(d) loading explosive into the blastholes comprising such a row of central blastholes for forming a row of spaced apart central explosive charges in the zone of unfragmented formation;

(e) loading explosive into the blastholes comprising such a row of outer blastholes adjacent such a side boundary of the retort for forming a row of spaced apart outer explosive charges in the zone of unfragmented formation, each outer explosive charge substantially filling the entire cross-sectional area of each outer blasthole, the scaled depth of burial of each such outer explosive charge being greater than the scaled depth of burial of each such central explosive charge; and (f) detonating the central and outer explosive charges for explosively expanding such a zone of unfragmented formation toward the limited void for forming a fragmented permeable mass of formation particles in the in situ retort.

19. The method according to claim 18 wherein the actual depth of burial of each outer explosive charge is about equal to the actual depth of burial of each central explosive charge.

20. The method according to claim 18 wherein the distance between adjacent outer blastholes is at least about one-half the distance between adjacent central blastholes.

21. The method according to claim 18 wherein the scaled depth of burial of such a row of outer explosive charges is about equal to the scaled depth of burial of such a row of central explosive charges.

22. The method according to claim 18 wherein such a limited void is a generally horizontally extending limited void and the central and outer explosive charges are substantially vertical columnar explosive charges.

23. The method according to claim 18 comprising detonating the central and outer explosive charges in such a zone of unfragmented formation in a single round of sequential detonations wherein the time delay between separate detonations in the sequence is sufficiently short so that proper interaction is achieved between all of the charges.

24. The method according to claim 18 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

25. The method according to claim 18 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

26. A method for forming a fragmented permeable mass of formation particles in an in situ retort in a subterranean formation, the in situ retort having top, bottom, and side boundaries of unfragmented formation, comprising the steps of:

(a) excavating at least one generally horizontally extending limited void within the retort boundaries in the subterranean formation, while leaving at least one zone of unfragmented formation within the retort boundaries having a substantially horizontally extending free face adjacent such a limited void;

(b) forming an array of generally vertical blastholes in such a zone of unfragmented formation comprising at least one row of horizontally spaced apart central blastholes remote from the side boundaries of the retort;

(c) forming a row of generally vertical outer blastholes in such a zone of unfragmented formation adjacent at least one side boundary of the retort, the distance between adjacent outer blastholes being less than the distance between adjacent central blastholes;

(d) loading explosive into the blastholes comprising such a row of central blastholes for forming a row of horizontally spaced apart columnar central explosive charges in the zone of unfragmented formation, the columnar central charges being about perpendicular to the horizontally extending free face;

(e) loading explosive into the blastholes comprising such a row of outer blastholes adjacent such a side boundary of the retort for forming a row of horizontally spaced apart columnar outer explosive charges in the zone of unfragmented formation, the columnar outer charges being about perpendicular to the horizontally extending free face, each outer explosive charge substantially filling the entire cross-sectional area of each outer blasthole, the scaled depth of burial of each such outer explosive charge being greater than the scaled depth of burial of each such central explosive charge; and (f) detonating the central and outer explosive charges for explosively expanding such a zone of unfragmented formation toward the limited void for forming a fragmented permeable mass of formation particles in the in situ retort.

27. The method according to claim 26 wherein the actual depth of burial of each outer explosive charge is about equal to the actual depth of burial of each central explosive charge.

28. The method according to claim 26 wherein the ratio of the distance between adjacent outer blastholes to the amount of explosive in each outer blasthole is about equal to the ratio of the distance between adjacent central blastholes to the amount of explosive in each central blasthole.

29. The method according to claim 26 wherein the ratio of the total amount of explosive in such a row of central explosive charges to the length of the row of central explosive charges is about equal to a ratio of the total amount of explosive in such a row of outer explosive charges to the length of the row of outer explosive charges.

30. The method according to claim 26 comprising detonating the central and outer explosive charges in such a zone of unfragmented formation in a single round of sequential detonations wherein the time delay between separate detonations in the sequence is sufficiently short so that proper interaction is achieved between all of the charges.

31. The method according to claim 26 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

32. The method according to claim 26 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

33. A method for forming a fragmented permeable mass of formation particles in an in situ oil shale retort in a subterranean formation containing oil shale, the in situ oil shale retort having top, bottom, and side boundaries of unfragmented formation, comprising the steps of:

(a) excavating at least one generally horizontally extending limited void within the retort boundaries in the subterranean formation, while leaving zones of unfragmented formation above and below such a limited void;

(b) forming a plurality of spaced apart substantially vertical central blastholes in such a zone of unfragmented formation remote from the side boundaries of the retort;

(c) forming a plurality of spaced apart substantially vertical outer blastholes in such a zone of unfragmented formation adjacent the side boundaries of the retort, the spacing distance between at least a first portion of such outer blastholes being less than the spacing distance between the central blastholes, wherein the distance from an outer blasthole comprising the first portion of outer blastholes to objects sensitive to damage by seismic shock is less than the distance from remaining outer blastholes to such objects;

(d) loading explosive into the central blastholes for forming a central explosive charge in each central blasthole;

(e) loading explosive into the outer blastholes for forming an outer explosive charge in each outer blasthole, such an outer explosive charge substantially filling the entire cross-sectional area of such an outer blasthole, the scaled depth of burial of each outer explosive charge in each outer blasthole of the first portion of outer blastholes being greater than the scaled depth of burial of such a central explosive charge; and (f) detonating the central and outer explosive charges for explosively expanding such a zone of unfragmented formation toward the limited void for forming a fragmented permeable mass of formation particles in the in situ oil shale retort.

34. The method according to claim 33 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

35. The method according to claim 33 wherein the actual depth of burial of each of the outer explosive charges is about the same as the actual depth of burial of each of the central explosive charges.

36. The method according to claim 33 wherein the spacing distance between the blastholes comprising the first portion of outer blastholes is at least about one-half the spacing distance between the central blastholes.

37. A method for forming a fragmented permeable mass of formation particles in an in situ oil shale retort in a subterranean formation containing oil shale, the in situ oil shale retort having top, bottom, and side boundaries of unfragmented formation, comprising the steps of:

(a) excavating at least one limited void within the retort boundaries in the subterranean formation, while leaving at least one zone of unfragmented formation within the retort boundaries adjacent such a limited void;

(b) forming an array of blastholes in such a zone of unfragmented formation comprising at least one row of spaced apart central blastholes remote from the side boundaries of the retort;

(c) forming a plurality of spaced apart outer blastholes in such a zone of unfragmented formation adjacent the side boundaries of the retort, the distance between adjacent first outer blastholes being less than the distance between adjacent central blastholes, wherein the distance from such a first outer blasthole to objects sensitive to damage by seismic shock is less than the distance from remaining outer blastholes to such objects;

(d) loading explosive into the central blastholes for forming a central explosive charge in each central blasthole;

(e) loading explosive into the outer blastholes for forming an outer explosive charge in each outer blasthole, such as outer explosive charge substantially filling the entire cross-sectional area of such an outer blasthole, the actual depth of burial of each such outer explosive charge being about equal to the actual depth of burial of each such central explosive charge while the energy per unit length of the outer explosive charge formed in a first outer blasthole is less than the energy per unit length of such a central explosive charge; and (f) detonating the central and outer explosive charges for explosively expanding the zone of unfragmented formation toward the limited void for forming a fragmented permeable mass of formation particles in the in situ oil shale retort.

38. The method according to claim 37 comprising detonating the central and outer explosive charges in such a zone of unfragmented formation in a single round of sequential detonations wherein the time delay between separate detonations in the sequence is sufficiently short so that proper interaction is achieved between all of the charges.

39. The method according to claim 37 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

40. The method according to claim 37 wherein the distance between adjacent first outer blastholes is at least about one-half the distance between adjacent central blastholes.

41. A method for forming a fragmented permeable mass of formation particles in an in situ oil shale retort in a subterranean formation containing oil shale, the in situ oil shale retort having top, bottom, and side boundaries of unfragmented formation, comprising the steps of:

(a) excavating at least one limited void within the retort boundaries in the subterranean formation, leaving at least one zone of unfragmented formation within the retort boundaries adjacent such a limited void;

(b) forming an array of blastholes in such a zone of unfragmented formation comprising at least one row of spaced apart central blastholes remote from the side boundaries of the retort;

(c) forming a row of outer blastholes in such a zone of unfragmented formation adjacent at least one side boundary of the retort, the distance between adjacent outer blastholes being less than the distance between adjacent central blastholes;

(d) loading explosive into the blastholes comprising such a row of central blastholes for forming a row of spaced apart central explosive charges in the zone of unfragmented formation;

(e) loading explosive into the blastholes comprising such a row of outer blastholes adjacent such a side boundary of the retort for forming a row of spaced apart outer explosive charges in the zone of unfragmented formation, each outer explosive charge substantially filling the entire cross-sectional area of each outer blasthole, the actual depth of burial of each such outer explosive charge being about equal to the actual depth of burial of each such central explosive charge while the energy per unit length of each such outer explosive charge is less than the energy per unit length of each such central explosive charge; and (f) detonating the central and outer explosive charges for explosively expanding such a zone of unfragmented formation toward the limited void for forming a fragmented permeable mass of formation particles in the in situ oil shale retort.

42. The method according to claim 41 wherein the distance between adjacent outer blastholes is at least about one-half the distance between adjacent central blastholes.

43. The method according to claim 41 wherein a row of outer blastholes is formed adjacent each side boundary of the retort.

44. The method according to claim 41 wherein the scaled depth of burial of such a row of outer explosive charges is about equal to the scaled depth of burial of such a row of central explosive charges.

45. The method according to claim 41 wherein the ratio of the distance between adjacent outer blastholes to the amount of explosive in each outer blasthole is about equal to the ratio of the distance between adjacent central blastholes to the amount of explosive in each central blasthole.

46. The method according to claim 41 wherein the ratio of the total amount of explosive in such a row of central explosive charges to the length of the row of central explosive charges is about equal to the ratio of the total amount of explosive in such a row of outer explosive charges to the length of the row of outer explosive charges.

47. The method according to claim 41 wherein the ratio of explosive energy per unit length of an outer charge to the distance between adjacent outer blastholes is about equal to the ratio of explosive energy per unit length of a central explosive charge to the distance between adjacent central blastholes.

48. The method according to claim 41 comprising detonating the central and outer explosive charges in such a zone of unfragmented formation in a single round of sequential detonations wherein the time delay between separate detonations in the sequence is sufficiently short so that proper interaction is achieved between all of the charges.

49. The method according to claim 41 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

50. The method according to claim 41 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

51. A method for forming a fragmented permeable mass of formation particles in an in situ oil shale retort in a retort site in a subterranean formation containing oil shale, comprising the steps of:

(a) excavating at least one limited void in the subterranean formation within the retort site, leaving at least one zone of unfragmented formation adjacent such a limited void;

(b) forming an array of spaced apart central blastholes in such a zone of unfragmented formation;

(c) forming a band of spaced apart outer blastholes in such a zone of unfragmented formation surrounding the array of central blastholes, the spacing distance between a plurality of first outer blastholes being less than the spacing distance between such central blastholes, such a first outer blasthole being smaller in diameter than such a central blasthole, wherein the distance from such a first outer blasthole to objects sensitive to damage by seismic shock is less than the distance from remaining outer explosive charges to such objects;

(d) loading explosive into the central blastholes for forming a central explosive charge in each central blasthole;

(e) loading explosive into the outer blastholes for forming an outer explosive charge in each outer blasthole, such an outer explosive charge in each first outer blasthole substantially filling the entire cross-sectional area of such a first outer blasthole, the actual depth of burial of each such outer explosive charge being about equal to the actual depth of burial of each such central explosive charge; and (f) detonating the central and outer explosive charges for explosively expanding such a zone of unfragmented formation toward the limited void for forming a fragmented permeable mass of formation particles in the in situ oil shale retort.

52. The method according to claim 51 wherein the spacing distance between the plurality of first outer blastholes is at least about one-half the spacing distance between the central blastholes.

53. The method according to claim 51 wherein the ratio of the spacing distance between the first outer blastholes to the amount of explosive in each first outer blasthole is about equal to the ratio of the spacing distance between the central blastholes to the amount of explosive in each central blasthole.

54. The method according to claim 51 comprising detonating the central and outer explosive charges in such a zone of unfragmented formation in a single round of sequential detonations wherein the time delay between separate detonations in the sequence is sufficiently short so that proper interaction is achieved between all of the charges.

55. The method according to claim 51 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

56. The method according to claim 51 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

57. A method for forming a fragmented permeable mass of formation particles in an in situ oil shale retort in a subterranean formation containing oil shale, the in situ oil shale retort having top, bottom, and side boundaries of unfragmented formation comprising the steps of:

(a) excavating at least one limited void within the retort boundaries in the subterranean formation, leaving at least one zone of unfragmented formation within the retort boundaries adjacent such a limited void;

(b) forming an array of blastholes in such a zone of unfragmented formation comprising at least one row of spaced apart central blastholes remote from the side boundaries of the retort;

(c) forming a row of outer blastholes in such a zone of unfragmented formation adjacent at least one side boundary of the retort, the distance between adjacent outer blastholes being less than the distance between adjacent central blastholes, wherein such outer blastholes are smaller in diameter than such central blastholes;

(d) loading explosive into the blastholes comprising such a row of central blastholes for forming a row of spaced apart central explosive charges in the zone of unfragmented formation;

(e) loading explosive into the blastholes comprising such a row of outer blastholes adjacent such a side boundary of the retort for forming a row of spaced apart outer explosive charges in the zone of unfragmented formation, each outer explosive charge substantially filling the entire cross-sectional area of such an outer blasthole, the actual depth of burial of each such outer explosive charge being about equal to the actual depth of burial of each such central explosive charge; and (f) detonating the central and outer explosive charges for explosively expanding such a zone of unfragmented formation toward the limited void for forming a fragmented permeable mass of formation particles in the in situ oil shale retort.

58. The method according to claim 57 wherein the distance between adjacent outer blastholes is at least about one-half the distance between adjacent central blastholes.

59. The method according to claim 57 wherein the scaled depth of burial of such a row of outer explosive charges is about equal to the scaled depth of burial of such a row of central explosive charges.

60. The method according to claim 57 wherein a row of outer explosive charges is formed adjacent each side boundary of the retort.

61. The method according to claim 57 wherein the ratio of the distance between adjacent outer blastholes to the amount of explosive in each outer blasthole is about equal to the ratio of the distance between adjacent central blastholes to the amount of explosive in each central blasthole.

62. The method according to claim 57 wherein the ratio of the total amount of explosive in such a row of central explosive charges to the length of the row of central explosive charges is about equal to the ratio of the total amount of explosive in such a row of outer explosive charges to the length of the row of outer explosive charges.

63. The method according to claim 57 comprising detonating the central and outer explosive charges in such a zone of unfragmented formation in a single round of sequential detonations wherein the time delay between separate detonations in the sequence is sufficiently short so that proper interaction is achieved between all of the charges.

64. The method according to claim 57 comprising detonating the central and outer explosive charges in such a zone of unfragmented formation in a single round of sequential detonations wherein the length of the time delay between separate detonations in the sequence is less than about 3 milliseconds per foot of spacing between an explosive charge in one delay and an adjacent explosive charge in the next delay in the sequence.

65. The method according to claim 57 comprising detonating the central and outer explosive charges in such a zone of unfragmented formation in a single round of sequential detonations wherein the length of the time delay between separate detonations in the sequence is about 1 millisecond per foot of spacing between an explosive charge in one delay and an adjacent explosive charge in the next delay in the sequence.

* * * * *

UNITED STATES PATENT AND TRADEMARK OFFICE

CERTIFICATE OF CORRECTION

PATENT NO. : 4,402,550

DATED : September 6, 1983

INVENTOR(S) : Thomas E. Ricketts

It is certified that error appears in the above-identified patent and that said Letters Patent is hereby corrected as shown below:

Column 3, line 35, "blastholes" should read -- blasthole --.

Column 7, line 46, "charging" should read -- changing --.

Column 15, line 50, claim 15, "as" should read -- an --.

Signed and Sealed this

*Twenty-second* Day of *November 1983*

[SEAL]

*Attest:*

GERALD J. MOSSINGHOFF

*Attesting Officer*

*Commissioner of Patents and Trademarks*